United States Patent [19]

Wedertz et al.

[11] 4,399,962

[45] Aug. 23, 1983

[54] WOBBLE NOSE CONTROL FOR PROJECTILES

[75] Inventors: Larry D. Wedertz, Mira Loma; Byron M. Niemeier, Claremont; Oakley G. Ross, Upland, all of Calif.

[73] Assignee: General Dynamics, Pomona Division, Pomona, Calif.

[21] Appl. No.: 298,128

[22] Filed: Aug. 31, 1981

[51] Int. Cl.[3] ..... F42B 15/14

[52] U.S. Cl. ..... 244/3.23

[58] Field of Search ..... 244/3.1, 3.11, 3.15, 244/3.16, 3.19, 3.21, 3.22, 3.23; 102/377, 384, 439, 501, 703

[56] References Cited

U.S. PATENT DOCUMENTS

| | | | |
|---|---|---|---|
| 3,014,426 | 12/1961 | Smith, Jr. et al. | 102/19 |
| 3,018,981 | 1/1962 | Weller | 244/14 |
| 3,028,807 | 4/1962 | Burton et al. | 102/49 |
| 3,067,682 | 12/1962 | Feldmann et al. | 102/49 |
| 3,069,112 | 12/1962 | Patterson | 244/3.19 |
| 3,145,949 | 8/1964 | Smith, Jr. et al. | 244/14 |
| 3,195,462 | 7/1965 | Petre | 102/49 |
| 3,233,848 | 2/1966 | Byrne | 244/14 |
| 3,262,655 | 7/1966 | Gillespie, Jr. | 244/1 |
| 3,416,758 | 12/1968 | Nicholson et al. | 244/130 |
| 3,425,650 | 2/1969 | Silva | 244/130 |
| 4,142,696 | 3/1979 | Nottingham | 244/3.16 |
| 4,170,330 | 10/1979 | Hertzberg et al. | 244/3.13 |

FOREIGN PATENT DOCUMENTS

| | | | |
|---|---|---|---|
| 160981 | 2/1955 | Australia | 90.3/90.5 |

*Primary Examiner*—Stephen C. Bentley
*Assistant Examiner*—Maureen Ryan
*Attorney, Agent, or Firm*—Neil F. Martin; Earl F. Kotts; Edward B. Johnson

[57] ABSTRACT

An articulated nose is locked in axial alignment with the longitudinal axis of a rolling projectile body. Pyrotechnic means within the nose is actuated to unlock the nose and tilt it toward the target when the error between the projectile path and the path to the target exceeds a predetermined threshold.

7 Claims, 7 Drawing Figures

WOBBLE NOSE CONTROL FOR PROJECTILES

BACKGROUND OF THE INVENTION

Projectiles with intentionally induced roll rates about their longitudinal axes have significant advantages over roll stabilized projectiles. The roll concept has been applied to air and surface launched missiles and projectiles. The projectile may be spun up initially by the launcher to several revolutions per second. With such a roll rate, it is possible to utilize a single control plane to guide the projectile in all three earth related axes.

An example of a control device for missiles utilizing a rotating body is demonstrated in U.S. Pat. No. 4,054,254 wherein steering control is accomplished by varying the incidence of two canard surfaces at the proper point in the rotation of the rolling airframe to guide the airframe in the desired direction.

Another example of a control device for rolling projectiles is disclosed in U.S. Pat. No. 3,868,883. This patent discloses a line of sight guidance system which can be used with the wobble nose projectile construction of the present invention.

A simple and inexpensive construction has been sought for controlling small supersonic ground launch projectiles generally used against targets at a distance of three or four kilometers for example. Such a construction must be rugged and easy to handle.

SUMMARY OF THE INVENTION

The present invention provides a simple ground launch projectile which includes an articulated nose cone locked in place at launch. As the ground tracker detects threshold error between the flight path of the projectile and the flight path to the position of the target, the nose cone is unlocked and selected pyrotechnic devices are ignited at the proper point of rotation of the projectile to tilt the nose toward the target and turn the projectile toward the target.

It is an object of the present invention to provide a new and improved directional control construction for projectiles that is simple and relatively low in cost.

It is another object of the present invention to provide a new and improved projectile directional control construction which includes actuating means that provides rapid response with low power initiation.

It is a further object of the present invention to provide a new and improved projectile directional control construction which provides positive actuation and high torque in a light weight, small volume, high reliability configuration.

IN THE DRAWINGS

DETAILED DESCRIPTION OF THE INVENTION

Figure 1:
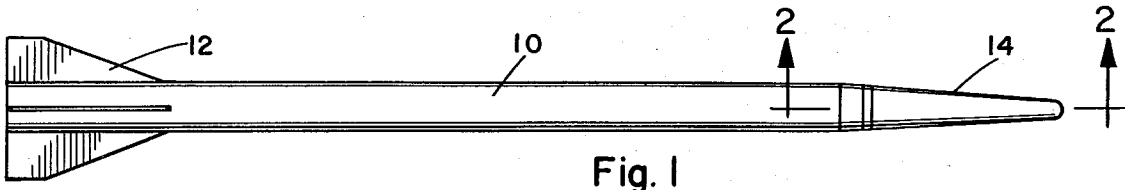
FIG. 1 is a side elevation of a projectile incorporating the wobble nose construction of the present invention.
Figure 2:
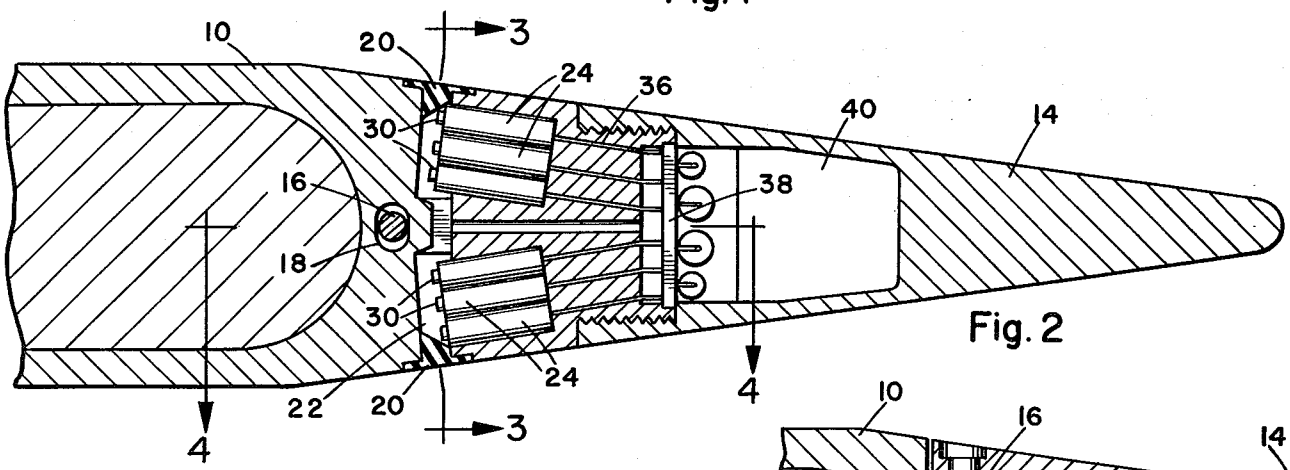
FIG. 2 is an enlarged sectional view taken on line 2—2 of FIG. 1.
Figure 4:
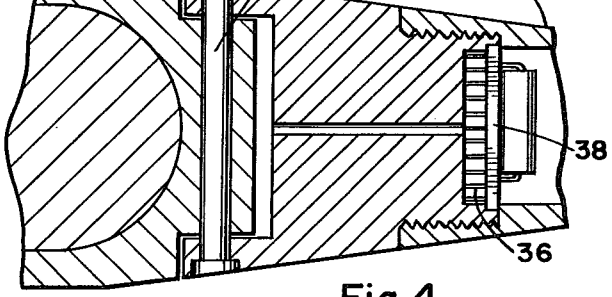
FIG. 4 is a sectional view taken on line 4—4 of FIG. 2.
Figure 3:
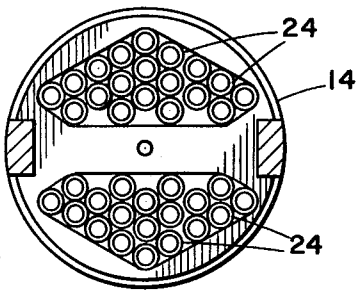
FIG. 3 is a sectional view taken on line 3—3 of FIG. 2.

Referring to the drawings, a supersonic projectile is shown in FIG. 1 and includes a cylindrical body 10 having fins 12 near the aft end of the body and a nose cone 14 connected to the forward end of the body. The nose cone 14 is coupled to the forward end of the projectile body 10 by a rod member 16 which is positioned in an elongated slot 18 in the projectile body, as shown in FIG. 2. The nose cone 14 is in the locked position in FIG. 1 of the drawings and is held aligned with the longitudinal axis of the projectile by the locking wedges 20 which are pressed into position in the opening 22 between the forward end of the projectile body and the nose cone.

Several pyrotechnic actuating cylinders 24 are provided in banks in the nose cone 14 on each side of the rod member 16. Each of these pyrotechnic actuators 24 includes a piston 28 and a piston rod 30. A pyrotechnic charge 32 is located in the bottom of the cylinder below the piston. An igniter 34 is electrically connected through conductors 36 to a circuit board 38 which in turn is electrically connected to a signal receiver 40 in the nose cone.

Figure 5:
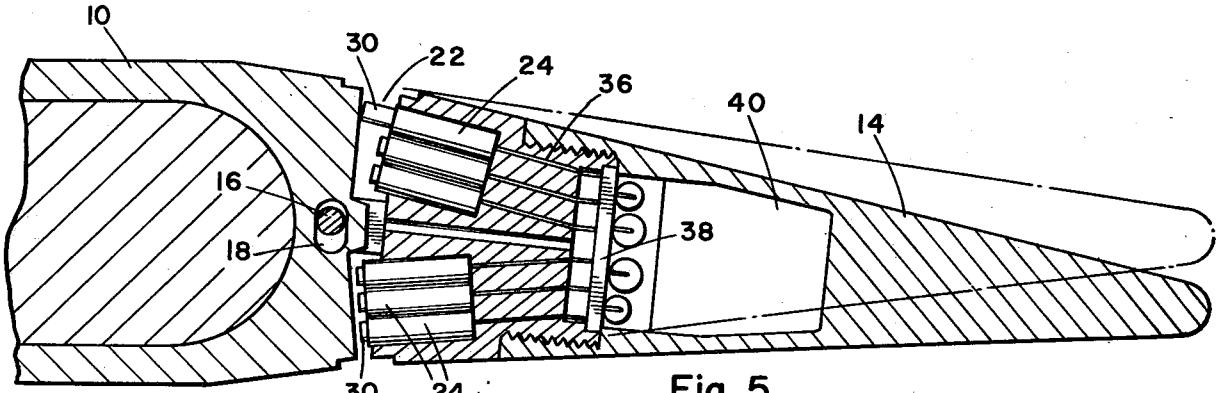
FIG. 5 is a view similar to FIG. 1 and showing the nose in the tilted position, deflected from the longitudinal axis of the projectile.
Figure 6:
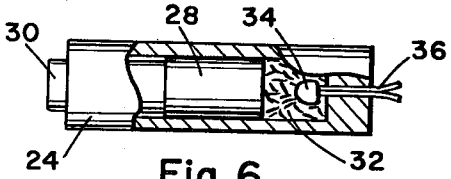
FIG. 6 is an enlarged side elevation view, partly cut away, showing one of the pyrotechnic actuators used to tilt the nose cone.
Figure 7:
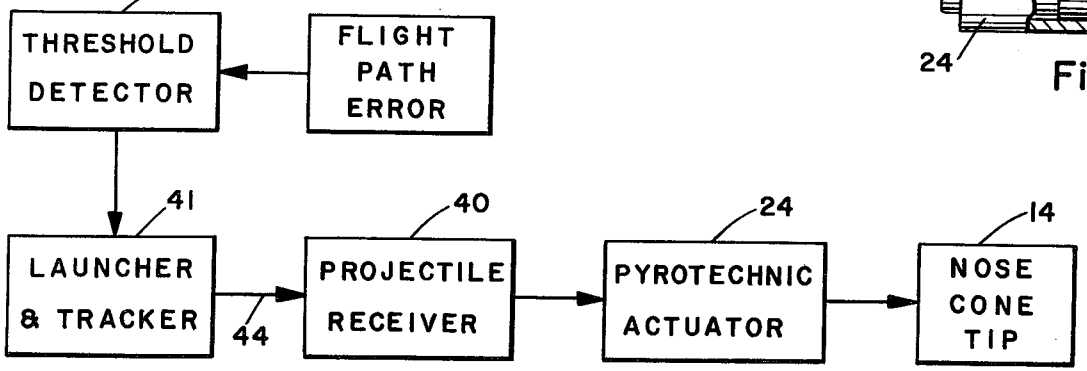
FIG. 7 is a block diagram demonstrating the operation of the control device of the present invention.

When the projectile is launched, it rotates at a predetermined rate such as ten revolutions per second. The tracker 41 at the ground launcher established the position of the target and the direction of the projectile upon launch. As the target moves or the projectile drifts off target so that the difference between the path to the target and the projectile path exceeds a predetermined threshold error established by threshold detector 42, the ground control tracker generates a control signal 44 which is received by receiver 40. The signal generated by the tracker is pulse modulated so that it will ignite one of the actuators 24 depending upon the direction of the error. Each actuator 24 is ignited by a different control signal. The actuators are ignited at a proper point in the rotation of the projectile so that the nose cone 14 is tilted toward the target and provides a greater surface in the flight path on one side of the longitudinal axis of the projectile to change its direction of flight. As shown in FIG. 5 of the drawings, the upper actuator 24 has been fired. The piston rod 30 immediately extends out of its cylinder and engages the forward portion of the projectile body. As this happens, the locking wedges 20 are blown out by the gas escaping around the piston and the gas escapes through the opening 22 to the atmosphere. The nose cone 14 is tilted downward and will change the course of the projectile downward. The aerodynamic lift developed by the nose cone 14 will pitch the projectile to an angle of attack, thus generating lift on the fins as well as on the nose in the direction to decrease the error. When the projectile body rotates to a point 180 degrees from the point where the first actuator was fired, another actuator is ignited to point the nose in the opposite direction with respect to the body and in the same space direction toward the target. The nose continues to tip back and forth or wobble until the error falls below the threshold. The control system does not function until the error once again increases above the threshold.

The fact that the projectile is rotating permits directional control in a single control plane so that control can be established in any direction.

The projectile construction of the present invention greatly increases the probability of a direct hit, requiring fewer rounds to defeat the target. It also increases the range capability of the projectile. These advantages decrease the vulnerability to counter attack.

Having thus described our invention, we claim:

1. A wobble nose projectile for launching at a target and having a cylindrical body that is rotatable in flight, comprising:

an articulated nose connected to the forward end of said projectile body and locked in axial alignment with the longitudinal axis of the said projectile body; and pyrotechnic means within said nose for unlocking the nose and tilting said nose toward the target when the directional error of the projectile exceeds a threshold.

2. A wobble nose projectile according to claim 1 wherein the nose is pivotal about an axis that is transverse to the longitudinal axis of the projectile body; and said pyrotechnic means comprises pyrotechnic elements within said nose on both sides of said transverse axis and arranged for selective ignition according to the direction of the error in the flight path of the projectile.

3. A wobble nose projectile according to claim 2 wherein said pyrotechnic elements include cylinders within said nose, a piston contained within each cylinder and a detonating charge in the cylinder behind said piston, the free end of said piston extending toward the forward end of said projectile body;

said piston extending against the forward end of said projectile body to tilt the nose relative to said body when said charge is detonated.

4. A wobble nose projectile according to claim 3 wherein said transverse pivot axis is formed by rod means on said nose extending through slot means in the projectile body.

5. A wobble nose projectile according to claim 4 wherein a space is provided between said nose and the forward end of said projectile body and said locking means is locked at the outer periphery of said space;

said locking means being removed by the gas from the ignition of said pyrotechnic pistons.

6. A wobble nose projectile according to claims 3 or 4 wherein said cylinders are provided in banks so that they are located in various radial positions relative to the longitudinal axis of the projectile body.

7. A wobble nose projectile for launching at a target and having a longitudinal body that is rotatable in flight, comprising:

as articulated nose having transverse rod means positioned in a slot at the forward end of said projectile body and positioned with a space between said nose and said projectile body;

locking means positioned at the outer periphery of said space, for locking said nose in axial alignment with the longitudinal axis of said projectile body;

a plurality of cylinders positioned within said nose on both sides of said rod means with a piston contained within each cylinder and a detonating charge in the cylinder behind said piston, the free end of said piston extending toward the forward end of said projectile body; and ignition means within said nose for selectively firing one or more of said pyrotechnic cylinders and removing said locking means, the piston in said ignited cylinder extending to contact the forward end of said projectile body to tilt said nose toward the target when the directional error of the projectile exceeds a threshold.

* * * * *